US009648972B2

(12) United States Patent
LeBlanc et al.

(10) Patent No.: US 9,648,972 B2
(45) Date of Patent: May 16, 2017

(54) SEAMING APPARATUS AND METHOD

(71) Applicants: Shane S LeBlanc, Bay St. Louis, MS (US); Lloyd L Lautzenhiser, Nobel (CA)

(72) Inventors: Shane S LeBlanc, Bay St. Louis, MS (US); Lloyd L Lautzenhiser, Nobel (CA)

(73) Assignee: Armorlock Industries, LLC, Bay St. Louis, MS (US)

( * ) Notice: Subject to any disclaimer, the term of this patent is extended or adjusted under 35 U.S.C. 154(b) by 158 days.

(21) Appl. No.: 14/309,632

(22) Filed: Jun. 19, 2014

(65) Prior Publication Data

US 2015/0366390 A1 Dec. 24, 2015

(51) Int. Cl.
*A47G 27/04* (2006.01)

(52) U.S. Cl.
CPC ..... *A47G 27/0462* (2013.01); *Y10T 156/1313* (2015.01)

(58) Field of Classification Search
CPC ..... Y10T 16/10; Y10T 16/14; Y10T 16/104; Y10T 16/109; Y10T 16/131; Y10T 428/24008; Y10T 428/24017; B60N 3/042; B60N 3/046; A47G 27/04; A47G 27/0406; A47G 27/0418; A47G 27/0431; A47G 27/045; A47G 27/0462; A47G 27/0437; A47G 27/0475; A47G 27/0293; A47G 27/025; E04F 13/088; E04F 13/0882; E04F 13/0885; E04F 13/0887; E04F 15/02044; E04F 15/02116; E04F 15/0215
See application file for complete search history.

(56) References Cited

U.S. PATENT DOCUMENTS 2,552,114 A * 5/1951 Reinhard ..... A47G 27/0462 156/304.4
2,664,589 A * 1/1954 Szpilberg ..... A47G 27/0462 16/16
3,413,678 A * 12/1968 Krantz ..... A47G 27/0462 16/16
3,673,633 A * 7/1972 Frebraro ..... A47G 27/0462 16/16
3,760,454 A * 9/1973 Heinzel ..... A47G 27/0462 16/16

(Continued)

FOREIGN PATENT DOCUMENTS

GB 269278 A * 4/1927 ..... A47G 27/0418
GB 1350767 A * 4/1974 ..... A47G 27/0462

*Primary Examiner* — Chuck Mah
(74) *Attorney, Agent, or Firm* — Duncan Galloway Egan Greenwald, PLLC; Kevin T. Duncan

(57) ABSTRACT

A seaming apparatus is formed from an elongated plate that is inextendible in both longitudinal and lateral directions. An upper surface of the plate is divided into multiple, transversely spaced and longitudinally extending zones. In the preferred embodiment, three such zones, including two edge zones spaced by a central zone, are provided. Numerous elongated upstanding sharp projections are provided in each of the edge zones and an adhesive layer is provided in the central zone. A peelable protective cover is arranged atop the adhesive layer. A thin adhesive layer with a peelable protective cover may be placed on a lower surface to secure the seaming apparatus to a supporting surface.

17 Claims, 15 Drawing Sheets

(56) References Cited

U.S. PATENT DOCUMENTS

| | | | | | |
|---|---|---|---|---|---|
| 3,858,269 | A * | 1/1975 | Sutton | A47G 27/0462 | 16/16 |
| 3,950,816 | A * | 4/1976 | Hill | A47G 27/0462 | 16/16 |
| 4,970,754 | A * | 11/1990 | Anderson | A47G 27/0462 | 16/16 |
| 5,104,475 | A * | 4/1992 | Foster | A47G 27/0443 | 156/304.3 |
| 5,500,980 | A * | 3/1996 | Morrow | A47G 27/0462 | 16/16 |
| 5,800,664 | A * | 9/1998 | Covert | A47G 27/0462 | 156/304.4 |
| 6,083,596 | A * | 7/2000 | Pacione | A47G 27/045 | 156/304.3 |
| 6,216,315 | B1 * | 4/2001 | Fuzzell | A47G 27/0418 | 16/16 |
| 6,708,367 | B2 * | 3/2004 | Billson | A47G 27/0462 | 16/16 |
| 2002/0068147 | A1 * | 6/2002 | Blum | A47L 23/22 | 428/131 |
| 2013/0187397 | A1 * | 7/2013 | Despins | A47G 27/04 | 294/8.6 |

* cited by examiner

SEAMING APPARATUS AND METHOD

BACKGROUND OF THE INVENTION

Field of the Invention

The present invention pertains to the art of carpets and artificial turf and, more particularly, to an apparatus for use in seaming carpet or artificial turf sections, as well as a method of utilizing the seaming apparatus. More particularly, the present invention relates to an apparatus and method for using said apparatus in applications where the backing on the carpet or artificial turf is exceedingly dense or thick.

Discussion of the Prior Art

When installing wall-to-wall carpeting, it is common practice to join various carpet sections by seaming abutting edge strips of the carpet sections. There has heretofore been utilized numerous types of seaming arrangements. These known seaming arrangements include sewing the abutting edge strips, adhesively joining the carpet sections through the use of a heat tape, and interconnecting the carpet sections through cleated connectors. In each case, the interconnection of the carpet sections is preformed manually by the installer.

Creating a seam by sewing carpet sections together can be extremely time consuming and can add considerable costs to the installation of the carpet. For these reasons alone, this seaming method is being utilized with less frequency in today's market. Utilizing heat tape in creating carpet seams, on the other hand, is extremely commonplace as it reduces required installation time and is quite cost effective. Unfortunately, drawbacks exist with respect to this seaming method as well. Although the need for additional tools such as a hot iron may be considered a drawback with such a seaming arrangement, the main drawback concerns the fact that it is extremely common for such a carpet seam to fail well before the carpet wears out. This fact is particularly prevalent in seamed wall-to-wall carpet installations where the entire carpet is stretched utilizing a power stretcher since stretching the carpet in this manner subjects the seam to rather large tension forces. In addition, based on the amount of adhesive utilized, high spots can be formed in the carpeted area and the minimization of such spots depends on the expertise of the installer. The concept of utilizing cleated connectors in creating carpet seams has been long before proposed as evidenced by the teachings in U.S. Pat. Nos. 2,552,114, 3,413,678 and 3,760,454. Unfortunately, each of these known arrangements have their associated drawbacks and have therefore not experienced much commercial success. In particular, these cleated connector arrangements are either not designed for use or simply not effective when utilized in power stretched wall-to-wall carpet installations due to their particular structure which enable them to stretch or flex in one or more directions, as well as the manner in which they are mounted to the carpet sections and supporting surfaces. There are also systems and methods for using a seaming apparatus to join two carpet seams in power stretched wall-to-wall installations as evidenced by U.S. Pat. No. 5,800,664 entitled "CARPET SEAMING APPARATUS AND METHOD OF UTILIZING THE SAME" and issued on Sep. 1, 1998, which is hereby incorporated by reference herein in its entirety.

In particular, the prior art carpet seaming methods and apparatuses do not perform adequately when the backing on the carpet, or in some applications artificial turf, is particularly thick or dense, such as with commercial carpeting typically found in offices, retail stores, and banks. The existing seaming apparatuses have short, triangular teeth that do not adequately "seat" or penetrate the backing of denser carpets or artificial turf. Hot melt tape and mesh/glue seaming methods are not desirable in these applications because carpets or artificial turf seamed using these methods are prone to failure and are particularly vulnerable to damage from moisture because the hot melt tape or glue used in these seaming methods are not waterproof.

When Seaming artificial turf for a residential lawn, Golf Course Turf, or Soccer Field/Football Field Turf, a mesh like seam tape, which is non-porous, and is used in conjunction with various adhesives so the adhesive will not seep through. The prior art method employs a two step approach. Existing methods may use a minimum of 12" wide tape and may use up to 36" wide tape depending upon the situation in which the "field" or turf will be used. Typically, in this method, the glue takes a full 24 hours to cure all the way through and the process of gluing down the mesh under existing methods is extremely labor intensive. The adhesive used must be notch trowelled on to the mesh to ensure an even coating of the glue across the entire tape. There are several drawbacks to using the prior art methods.

The adhesive used in these methods is either a synthetic, rubber, or other chemical makeup. There are petroleum distillates in many of them and the chemicals may cause problems and produce hazardous side effects. Typically, artificial turf heats up to 3 times the temperature of sod. When this happens, the chemicals in the adhesive can "gas". This not only causes the seam to rise up and "peak" off of the substrate or supporting surface, but also releases harsh vapors. If there is too much glue or adhesive applied to the seam, the chemicals in the adhesives can eat away at or dissolve the rubber backings of the turf itself when the field is heated up by the outdoor sun.

What is needed is a carpet or artificial turf seaming method that is suited for use in applications where the backing on the carpet or artificial turf is particularly dense or thick, and also where the seam should be both waterproof and wear resistant without creating a "hump" or profile in the carpet seam.

SUMMARY OF THE INVENTION

The carpet seaming apparatus of the present invention provides a durable seam in both commercial carpet and artificial turf applications. The seam secured by the seaming apparatus is both more secure and more durable than those in the prior art. The tape used in the seaming apparatus is waterproof to provide wear resistance in both outdoor and high traffic, frequently cleaned indoor applications. Furthermore, in the event of seam failure, a smaller area of carpet or turf would need to be removed or replaced due to the narrow profile of the seaming apparatus.

The carpet seaming apparatus of the present invention may use as its main adhesive layer a pressure sensitive butyl rubber tape. Butyl rubber is an inert substance and will not gas. Because of its natural state, butyl rubber tape stays pliable to extreme hot and cold temperatures. The metal "plate" of our product ensures that the seam will not "peak" and the teeth hold the backings in place. Typically seam failure is the primary cause of turf failure and the average cost of fixing a seam is $5000.00. There are typically 30-40 seams in a conventional artificial turf football field installation. Therefore there are many potential costly points of failure in an artificial turf installation using the mesh seam method. Expensive seam repairs will not be required using the seaming apparatus and method of the present invention.

The carpet seaming apparatus of the present invention is formed from an elongated plate that is inextendible in both longitudinal and lateral directions. In the preferred embodiment, a thin metal plate is utilized, however, the plate could be formed from rigid plastic. The plate has a lower surface that may also have a thin pressure sensitive adhesive layer which enables the plate to be readily secured upon a supporting surface. An upper surface of the plate is divided into multiple, transversely spaced, and longitudinally extending zones. In the preferred embodiment, three such zones, including two edge zones spaced by a central zone, are provided. Numerous elongated upstanding sharp projections are provided in each of the edge zones and a double-sided adhesive tape is provided in the central zone. A peelable protective cover is arranged atop the pressure sensitive adhesive tape. For indoor/interior applications of the invention a pressure sensitive fiber tape that is "water resistant" may be used. For indoor applications that will be frequently cleaned with steam or exposed to water or for outdoor/exterior applications, a completely waterproof pressure sensitive butyl rubber tape will be used.

In a first embodiment of the invention, the plate may be cut in length to correspond to the width dimension of the carpet sections to be seamed. The carpet padding, carpet, or artificial turf are arranged to the surface on which they are placed, and terminal edge portions of the carpet sections to be seamed are attached to the plate through the projections and the adhesive tape. The elongated projections in the edge zones of the plate extend into the carpet or turf, and the adhesive tape further secures the backing of the carpet or turf to the seaming apparatus. The seaming apparatus may be either glued in place with hot melt tape or secured with a pressure sensitive fiber tape. In another embodiment, the seaming apparatus may have no adhesive or securing layer on the back of the seaming apparatus.

In another embodiment, the plate of the present invention may have a double sided pressure sensitive fiber tape on the back or bottom of the plate and a waterproof pressure sensitive butyl rubber tape in the center portion of the top side of the plate. A carpet padding or other padding is first glued to a supporting surface, and the underside of the carpet or artificial turf, except for the area around the seams, is glued to the carpet padding. The area around the seam may be a 3 inch wide strip of the underside of the carpet or artificial turf. The plate is then installed in the seam by removing a covering on the double sided pressure sensitive fiber tape on the bottom of the plate, and the underside of the carpet or artificial turf is secured to the elongated projections of the edge zones and to the pressure sensitive butyl rubber tape on the top of the seaming apparatus. In this embodiment, the center zone of the plate may be proportionally larger than each of the edge zones of the plate.

In another embodiment the present invention provides a seaming apparatus comprising: an elongated plate having an upper surface and a lower surface, said lower surface being substantially smooth and said upper surface being divided into multiple transversely spaced and longitudinally extending zones including first and second edge zones which are laterally spaced by a central zone, said plate being inextendible in both longitudinal and lateral directions; a plurality of sharp, elongated projections extending upwardly at spaced locations from said first and second edge zones, said projections having a top and an elongated body portion, the top being sharply tapered to promote piercing engagement with a floor covering backing and the elongated body extending upwards from the upper surface at an angle of less than 90 degrees; and a pressure sensitive adhesive layer positioned within said central zone and extending substantially entirely the length of said elongated plate, said plate being adapted to be positioned upon a supporting surface and interconnected to floor covering sections to be seamed by positioning said plate below said floor covering sections with terminal edge portions of said floor covering sections being fixably engaged with said adhesive layer and with a respective set of said projections and abutting in said central zone.

In another embodiment the present invention provides a method of seaming two floor covering sections comprising: arranging edge portions of the floor covering sections juxtaposed one another upon a support surface; positioning an elongated, inextendible plate upon the support surface, the lower surface of said plate directly contacting the support surface below the respective edge portions of said floor covering sections, the plate having a substantially smooth lower surface, an upper surface provided with first and second longitudinally extending edge zones having a plurality of sharp, elongated projections extending upwardly at spaced locations from said first and second edge zones, said projections having a top and an elongated body portion, the top being sharply tapered to promote piercing engagement with a floor covering backing and the elongated body extending upwards from the upper surface at an angle of less than 90 degrees, and a central, adhesive containing zone extending substantially entirely the length of said elongated plate; and interengaging the edge portion of one of the floor covering sections with the projections provided in said first edge zones and interengaging the edge portion of the other of the floor covering sections with the projections provided in said second edge zone while adhesively joining the edge portions of the carpet sections together in an abutting manner in said central zone.

In another embodiment the present invention provides a carpet seaming apparatus comprising: an elongated plate having an upper surface and a lower surface, said lower surface being substantially smooth and said upper surface being divided into multiple transversely spaced and longitudinally extending zones including first and second edge zones which are laterally spaced by a central zone, said plate being inextendible in both longitudinal and lateral directions; a plurality of sharp, elongated projections extending upwardly at spaced locations from said first and second edge zones; and a pressure sensitive adhesive layer positioned within said central zone and extending substantially entirely the length of said elongated plate, said plate being adapted to be positioned upon a supporting surface and interconnected to carpet sections to be seamed by positioning said plate below said carpet sections with terminal edge portions of said carpet sections being engaged with a respective set of said projections and abutting in said central zone.

This carpet seaming embodiment of the present invention may also have projections located solely in said first and second edge zones. The lower surface of the apparatus may have a thin adhesive layer. The adhesive layer may be located solely in said central zone, and may be a pressure sensitive butyl rubber tape or a pressure sensitive fiber tape. The plate may be formed of metal and the projections may be constituted by cut portions of said plate which are bent upwardly above said upper surface. The projections may be angled toward said central zone, and may be angled toward the central zone at an angle of 70 degrees from the upper surface. The projections may be 8 mm in length from an attached proximal end to a projecting distal end, or may be 5.5 mm in length from an attached proximal end to a projecting distal end. The projections may be arranged in three or four columns in each of said edge zones. The projections may be arranged in offset rows in each of said edge zones, said rows having one, two, three, or four projections in each row. The adhesive layer may comprise a double-sided pressure sensitive adhesive tape having a lower side adhered to said central zone and an upper side adapted to be adhesively secured to the carpet sections, and may have a protective, peelable cover positioned atop said adhesive tape. The central zone may comprise greater than 33.3% of the width of the plate. The central zone and edge zones may each comprise 33.3% of the width of the plate.

In another embodiment, the present invention provides a method for seaming a carpet comprising: gluing down a padding layer and a carpet layer, said glued carpet and padding layers having a seam comprising a first and second terminal end; placing a seaming apparatus by removing a peelable backing from a thin lower adhesive layer in said seam, said seaming apparatus comprising an elongated plate having an upper surface and a lower surface, said lower surface being substantially smooth and having the thin lower adhesive layer positioned thereon, and said upper surface being divided into multiple transversely spaced and longitudinally extending zones including first and second edge zones which are laterally spaced by a central zone, said plate being inextendible in both longitudinal and lateral directions; a plurality of sharp, elongated projections extending upwardly at spaced locations from said first and second edge zones; and a pressure sensitive adhesive layer positioned within said central zone and extending substantially entirely the length of said elongated plate; and securing said first and second terminal ends to said pressure sensitive adhesive layer and engaging said first and second terminal ends to said plurality of projections.

In yet another embodiment, the present invention provides a method for seaming a carpet comprising: gluing down a padding layer and a carpet layer, said glued carpet and padding layers having a seam comprising a first and second terminal end; placing a seaming apparatus in said seam, said seaming apparatus comprising an elongated plate having an upper surface and a lower surface, said lower surface being substantially smooth, and said upper surface being divided into multiple transversely spaced and longitudinally extending zones including first and second edge zones which are laterally spaced by a central zone, said plate being inextendible in both longitudinal and lateral directions; a plurality of sharp, elongated projections extending upwardly at spaced locations from said first and second edge zones; and a pressure sensitive adhesive layer positioned within said central zone and extending substantially entirely the length of said elongated plate; and securing said first and second terminal ends to said pressure sensitive adhesive layer and engaging said first and second terminal ends to said plurality of projections.

Additional features and advantages of the carpet seaming apparatus of the present invention will become more readily apparent from the following detailed description of the preferred embodiment thereof, when taken in conjunction with the drawings wherein like reference numerals refer to corresponding parts in the several views.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

Figure 1:
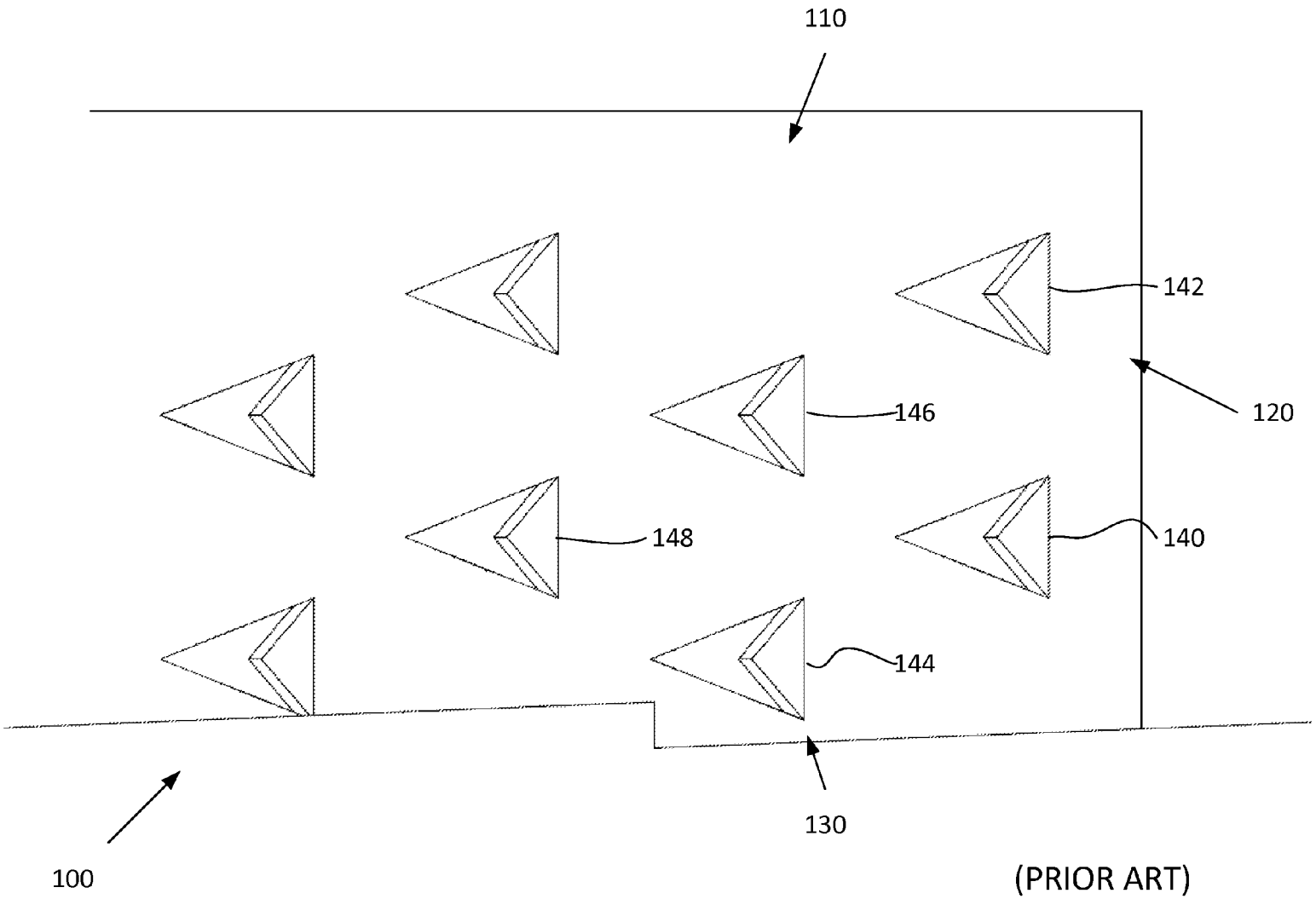
(PRIOR ART) Figure 1
FIG. 1 is a plan view of upstanding projections in a seaming apparatus of the prior art.

With reference to FIG. 1, a detailed plan view of a prior art carpet seaming apparatus 100 is provided. The entirety of the prior art apparatus 100 comprises two edge zones and a central zone that define the length of a galvanized steel strip. Seen in FIG. 1 is a detailed view of one of the edge zones of the apparatus 100. The prior art apparatus 100 has a set of sharp, triangular shaped, upstanding projections 110 arranged in rows 120 and columns 130. The rows 120 and columns 130 are arranged to provide for maximum effectiveness of the upstanding projections 110. In one embodiment, the distance between the distal end of one projection in a row 120 to the proximal end of the next projection is 8.8 mm. In this embodiment, the distance between the distal end of projection 140 and the proximal end of projection 148 is 8.8 mm. The length of each projection 110, for example projection 140, from the proximal to the distal end is 4 mm. The length of the proximal end of each projection 110, for example projection 140, may be 3.2 mm. The distance between each projection in each column 130, for example the distance between projection 140 and 142, may be 3.2 mm. Each column 130 is latitudinally offset from the next row in the set of projections 110 as can be seen in the sets of projections 140 and 142, and 144 and 146.

Figure 2:
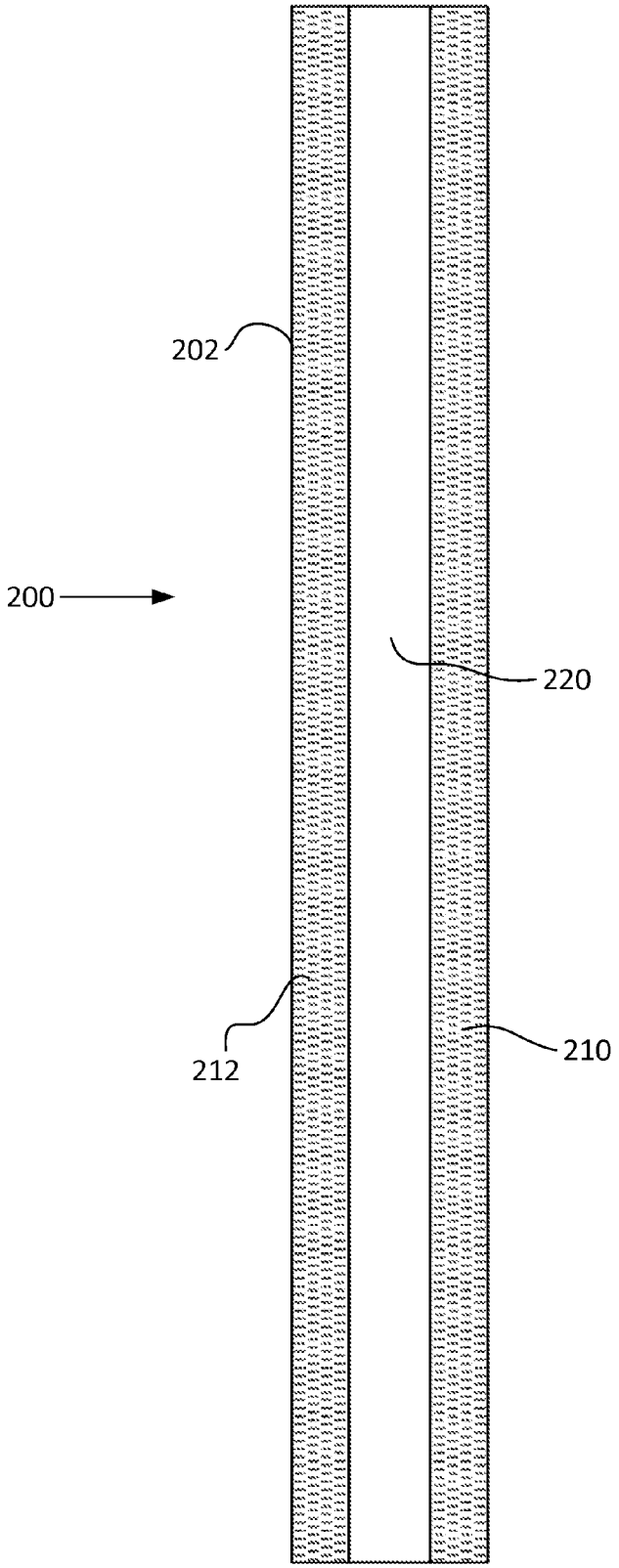
FIG. 2 is a plan view of an embodiment of a seaming apparatus of the present invention.

With reference now to FIG. 2, a plan view of the seaming apparatus 200 of the present invention is provided. Seaming apparatus 200 comprises an elongated plate 202. The plate 202 is preferably formed from metal so as to be inextendible in both longitudinal and transverse directions. In the preferred embodiment, the plate 202 is formed from galvanized sheet metal and is 152.4 mm in width. It is to be understood that other inextendible materials, including a rigid plastic material, could be utilized to form plate 202.

The upper surface of plate 202 is divided into three zones. The adhesive zone 220 and edge zones 210 and 212 generally define strips that run the full length of plate 202. In a preferred embodiment, the central adhesive zone 220 is 63.5 mm in width and both edge, or "tooth", zones 210 and 212 are 44.45 mm in width.

Positioned on the upper surface of the plate 202 and within the central adhesive zone 220 is a strip of adhesive. In indoor implementations of the present invention, a pressure sensitive adhesive with fiber glass fibers intertwined will be used. This type of adhesive may be a pressure sensitive fiber type. In outdoor implementations of the present invention, a pressure sensitive butyl rubber tape will be used. Using a butyl rubber tape in outdoor implementations is preferred due to the water resistant qualities of the butyl rubber tape. Using glues or adhesives other than a rubber tape in outdoor implementations may weaken the seam and cause seam failure over time. In either indoor or outdoor implementations, a peelable protective cover may be placed on top of the strip of adhesive in the central adhesive zone 220. Although preferred embodiments of the invention use a form of adhesive tape, it should be readily understood that other types of arrangements could be utilized to provide a layer of adhesive in the central adhesive zone 220.

The use of the seaming apparatus 200 is a great improvement over seaming methods for artificial turf in the prior art. Currently, the preferred method for seaming artificial turf in the prior art comprises using a 30 inch wide mesh with gallons of rubber based adhesive "troweled" onto the mesh to secure the seam. Troweling is spreading glue in a pattern that scrapes away glue in rows so that the glue can flatten out. If this type of seam fails, 30 inches of artificial turf must be cut out and replaced which may be very costly. Using the seaming apparatus of the present invention, the seam will both be stronger and a smaller amount of artificial turf would have to be replaced in the event of seam failure.

In each of the edge zones 210 and 212, a plurality of sharp upstanding projections arranged in rows and columns are provided throughout the surface of the edge zones 210 and 212. The specific arrangement of the plurality of upstanding projections is illustrated in greater detail in FIGS. 3 and 4.

Figure 3:
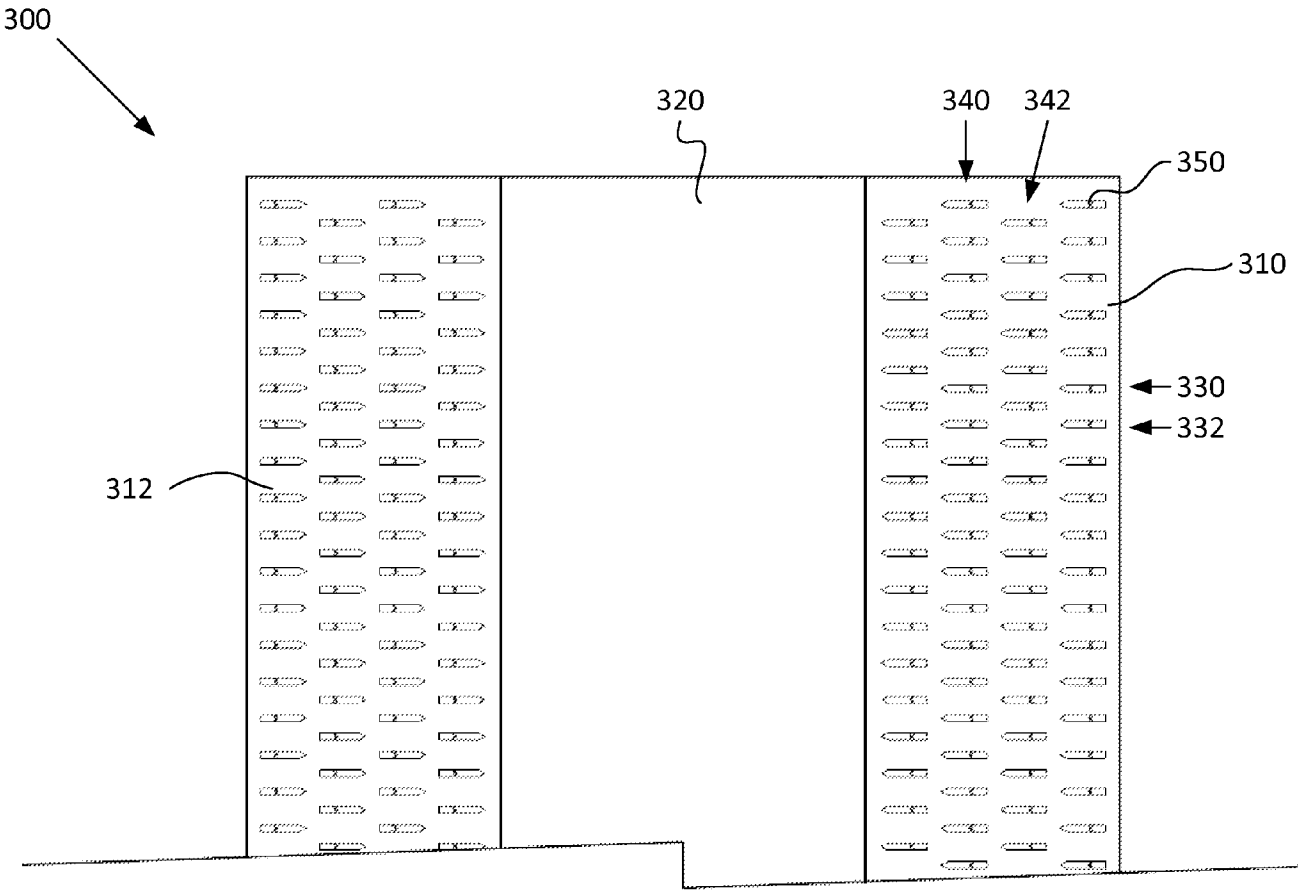
FIG. 3 is a plan view of the terminal end of an embodiment of a seaming apparatus of the present invention.

With reference now to FIG. 3, an end portion 300 of a seaming apparatus according to the present invention is provided. The end portion 300 primarily comprises a central adhesive portion 320 and edge portions 310 and 312. The edge portion 310 has a plurality of upstanding projections 350 arranged in rows, such as rows 330 and 332, and columns, such as columns 340 and 342. The particular arrangement of the upstanding projections in this embodiment provide a substantial improvement over the prior art. Each upstanding projection, such as projection 350, is "nail" shaped compared to the "triangular" shaped projections 110 seen in the prior art. The length of each projection is 8.0 mm from the proximal to the distal end, and the width of each projection is 1.2 mm. The necessity of the longer, narrower projections is due to the thickness and density of artificial turf. Artificial turf has a much greater density and overall height, and in order to penetrate and secure the backing of the artificial turf, each projection 350 must be longer and narrower than those provided in the prior art. The distance between the rows, such as rows 330 and 332 and columns 340 and 342 has also changed relative to that of the prior art to increase effectiveness when used to secure artificial turf. The projections can be seen in greater detail in FIG. 4.

Figure 4:
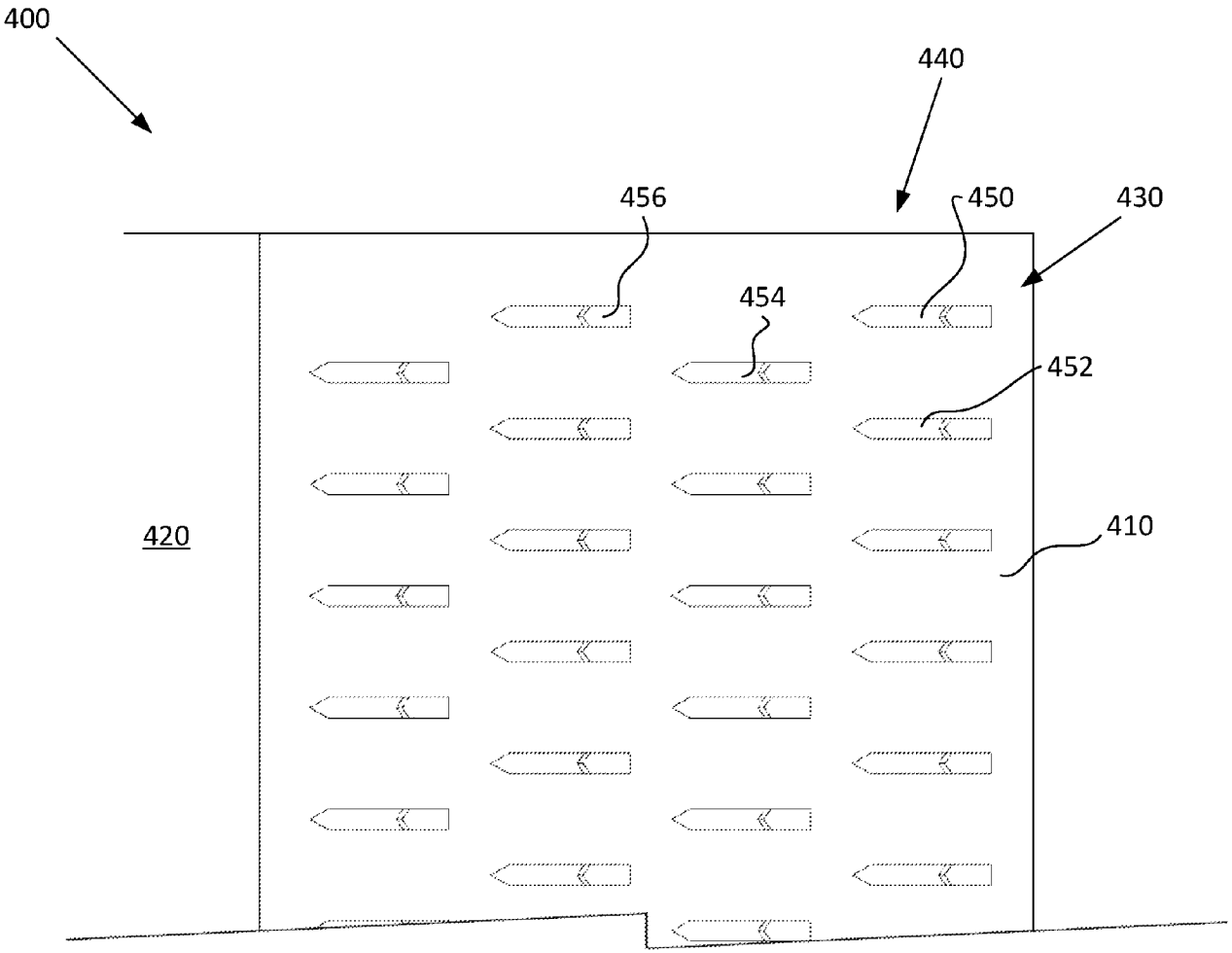
FIG. 4 is a plan view of upstanding projections in an embodiment of a seaming apparatus of the present invention.

With reference now to FIG. 4, a detailed view of the corner 400 of the seaming apparatus is provided. The edge zone 410 and central adhesive zone 420 are shown. The edge zone 410 is provided throughout its length with upstanding projections, such as projections 450, 452, 454, and 456, arranged in rows, such as row 430, and columns, such as columns 440. The projections in the edge zone 410 are arranged in four columns covering the entire length of the edge zone 410. In a preferred embodiment, each projection, such as projection 450, is 8 mm in length from the attached proximal end to the protruding distal end. The width of projection 450 is 1.2 mm. The distance between each projection, such as projections 450 and 452 in column 440 is 5.2 mm. The distance between the distal end of projection 450 and the proximal end of projection 454 is 2.4 mm. The distance between the distal end of the projection 450 and the proximal end of projection 456 in row 430 is 12.8 mm. The projections, arranged in rows and columns, are equally spaced throughout the edge zone 410.

Figure 5A:
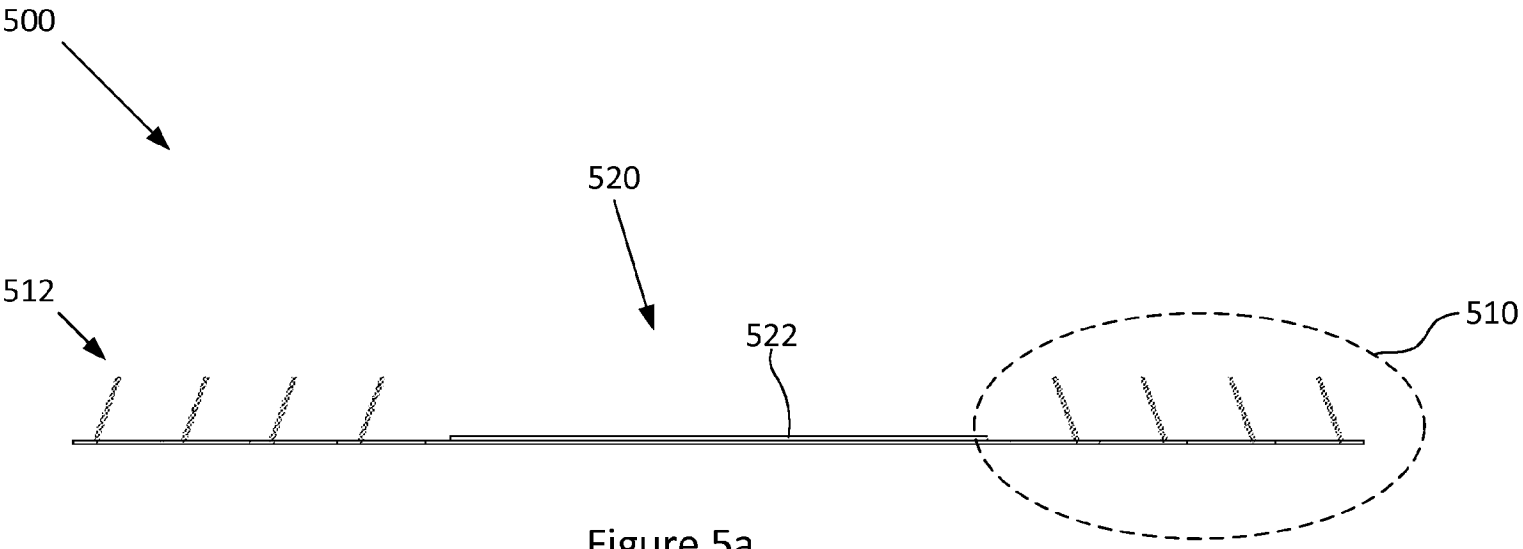
FIG. 5*a* is a cross-sectional view of an embodiment of a seaming apparatus of the present invention.

With reference now to FIG. 5*a*, a lateral view of the seaming apparatus 500 according to the present invention is provided. The seaming apparatus 500 is divided into edge zones 510 and 512 and central adhesive zone 520. Situated on the upper planar surface of the central zone 520 is an adhesive strip 522. The adhesive strip may be either a pressure sensitive fiber tape or pressure sensitive rubber tape depending on the desired application of the seaming apparatus 500. The edge zone 510 can be seen in greater detail in FIG. 5*b*.

Figure 5B:
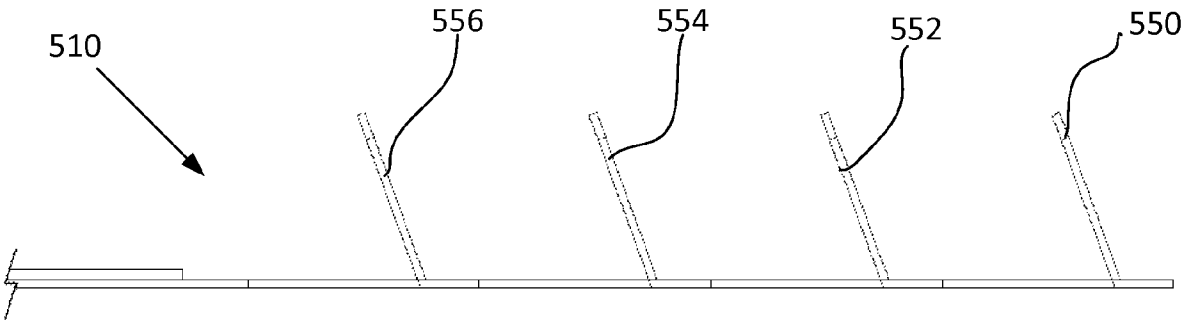
FIG. 5*b* is a detailed view of a cross-section of the upstanding projections of an embodiment of a seaming apparatus of the present invention.

With reference now to FIG. 5*b*, a detailed lateral view of edge zone 510 is provided. Four upstanding projections 550, 552, 554, and 556 are provided. The projections 550 and 554 would be arranged in the same row, while projections 552 and 556 would be in the same row. Each projection 550, 552, 554, and 556 would be in separate columns in the edge zone 510. In a preferred embodiment, the length of each projection from the attached proximal end to the protruding distal end is 8 mm. Each projection protrudes at an angle of 70 degrees from the upper planar surface of the edge zone 510. The distance from the surface of the edge zone 510 to the distal end of the projection 550 would be 7.5 mm if the projection is protruding at an angle of 70 degrees. The particular angle, length, width, and arrangement of the projections in the edge zone is designed to optimally secure an artificial turf seam.

Figure 6:
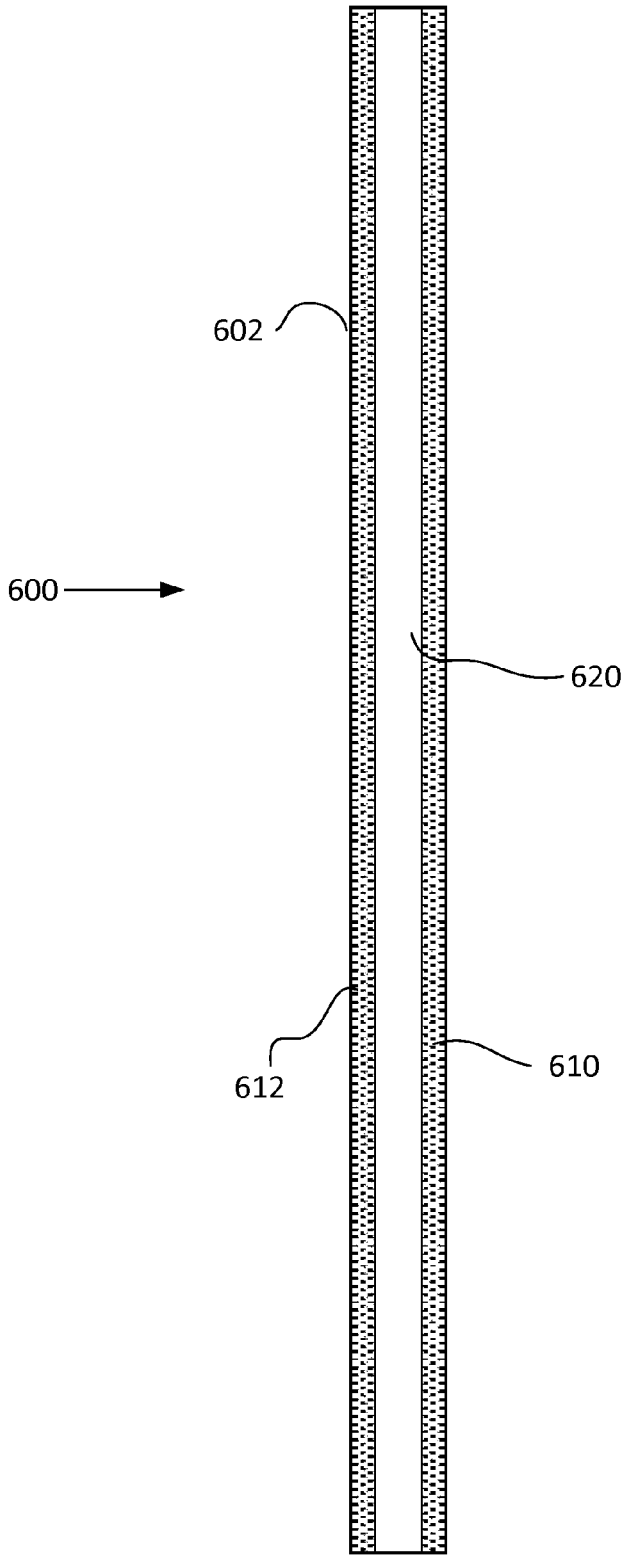
FIG. 6 is a plan view of another embodiment of a seaming apparatus of the present invention.

With reference now to FIG. 6, a plan view of the seaming apparatus 600 of the present invention is provided. Seaming apparatus 600 comprises an elongated plate 602. The plate 602 is preferably formed from metal so as to be inextendible in both longitudinal and transverse directions. In the preferred embodiment, the plate 602 is formed from galvanized sheet metal and is 76.2 mm in width. It is to be understood that other inextendible materials, including a rigid plastic material, could be utilized to form plate 602.

The upper surface of plate 602 is divided into three zones. The adhesive zone 620 and edge zones 610 and 612 generally define strips that run the full length of plate 602. In a preferred embodiment, the central adhesive zone 620 is 36.5 mm in width, or 41.6% of the width, and both edge, or "tooth", zones 610 and 612 are 19.85 mm in width, or a total of 58.4% of the width.

Positioned on the upper surface of the plate 602 and within the central adhesive zone 620 is a strip of adhesive. In a preferred embodiment of the present invention, a pressure sensitive butyl rubber tape will be used. Using a butyl rubber tape in indoor implementations is preferred due to the water resistant qualities of the butyl rubber tape. Water resistance is desired due to the frequent cleaning that a high traffic carpet may require. Using glues or adhesives other than a rubber tape in this indoor implementation may weaken the seam and cause seam failure over time. A peelable silicon protective cover may be placed on top of the strip of adhesive in the central adhesive zone 620. Although preferred embodiments of the invention use a form of adhesive tape, it should be readily understood that other types of arrangements could be utilized to provide a layer of adhesive in the central adhesive zone 620.

In each of the edge zones 610 and 612, a plurality of sharp upstanding projections arranged in rows and columns are provided throughout the surface of the edge zones 610 and 612. The specific arrangement of the plurality of upstanding projections is illustrated in greater detail in FIGS. 7 and 8.

Figure 7:
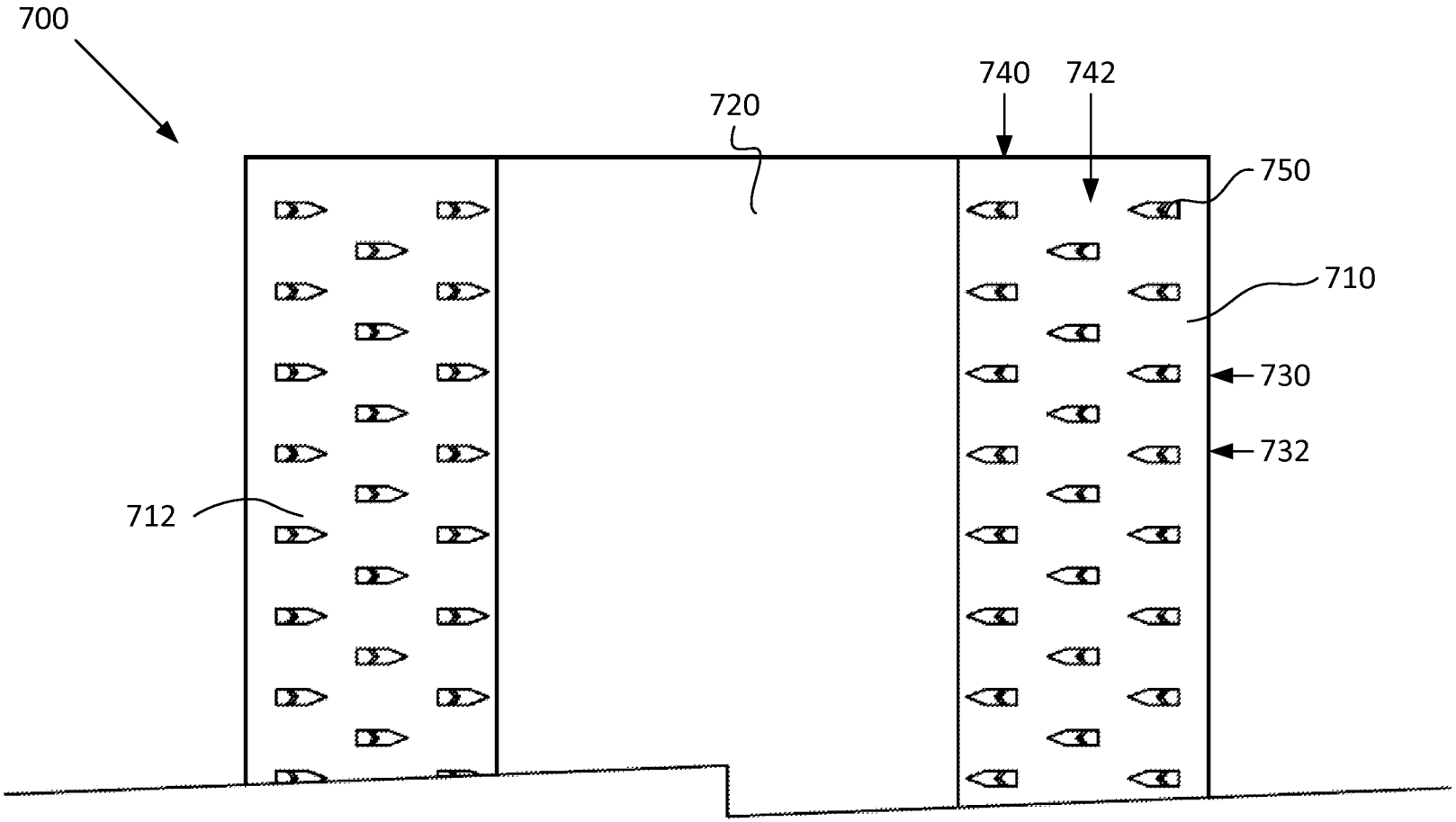
FIG. 7 is a plan view of the terminal end of an embodiment of a seaming apparatus of the present invention.

With reference now to FIG. 7, an end portion 700 of a seaming apparatus according to the present invention is provided. The end portion 700 primarily comprises a central adhesive portion 720 and edge portions 710 and 712. The edge portion 710 has a plurality of upstanding projections 750 arranged in rows, such as rows 730 and 732, and columns, such as columns 740 and 742. The particular arrangement of the upstanding projections in this embodiment provide a substantial improvement over the prior art. Each upstanding projection, such as projection 750, is "nail" shaped compared to the "triangular" shaped projections 110 seen in the prior art. The length of each projection is 4.0 mm from the proximal to the distal end, and the width of each projection is 1.2 mm. The necessity of the longer, narrower projections is due to the thickness and density of the backings in commercial carpet applications. Commercial type carpeting backing has a much greater density, and in order to penetrate and secure the backing of the carpeting, each projection 750 must be longer and narrower than those provided in the prior art. The distance between the rows, such as rows 730 and 732 and columns 740 and 742 has also changed relative to that of the prior art to increase effectiveness when used to secure commercial carpeting. Furthermore, the narrower projections "seat" properly in denser carpets compared to the prior art. The prior art projections may create "humps" or profiles in the carpet seams because they do not seat properly in denser carpeting. The projections of the present invention minimize profiling and may be used with denser or "woven" carpeting as is normally used in commercial carpeting applications. The projections can be seen in greater detail in FIG. 8.

Figure 8:
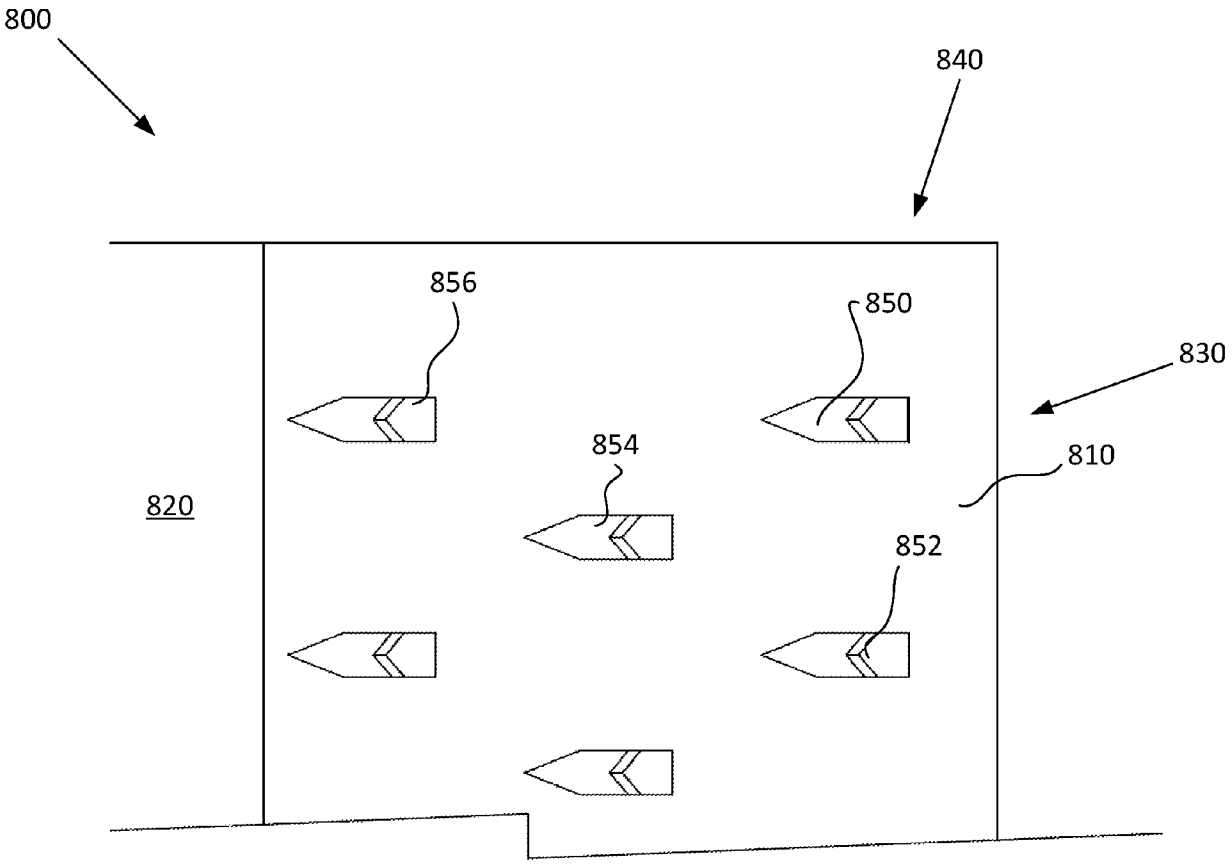
FIG. 8 is a plan view of upstanding projections in an embodiment of a seaming apparatus of the present invention.

With reference now to FIG. 8, a detailed view of the corner 800 of the seaming apparatus is provided. The edge zone 810 and central adhesive zone 820 are shown. The edge zone 810 is provided throughout its length with upstanding projections, such as projections 850, 852, 854, and 856, arranged in rows, such as row 830, and columns, such as columns 840. The projections in the edge zone 810 are arranged in three columns covering the entire length of the edge zone 810. In a preferred embodiment, each projection, such as projection 850, is 4 mm in length from the attached proximal end to the protruding distal end. The width of projection 850 is 1.2 mm. The distance between each projection, such as projections 850 and 852 in column 840 is 5.2 mm. The distance between the distal end of projection 850 and the proximal end of projection 854 is 2.4 mm. The distance between the distal end of the projection 850 and the proximal end of projection 856 in row 830 is 8.8 mm. The projections, arranged in rows and columns, are equally spaced throughout the edge zone 810.

Figure 9A:
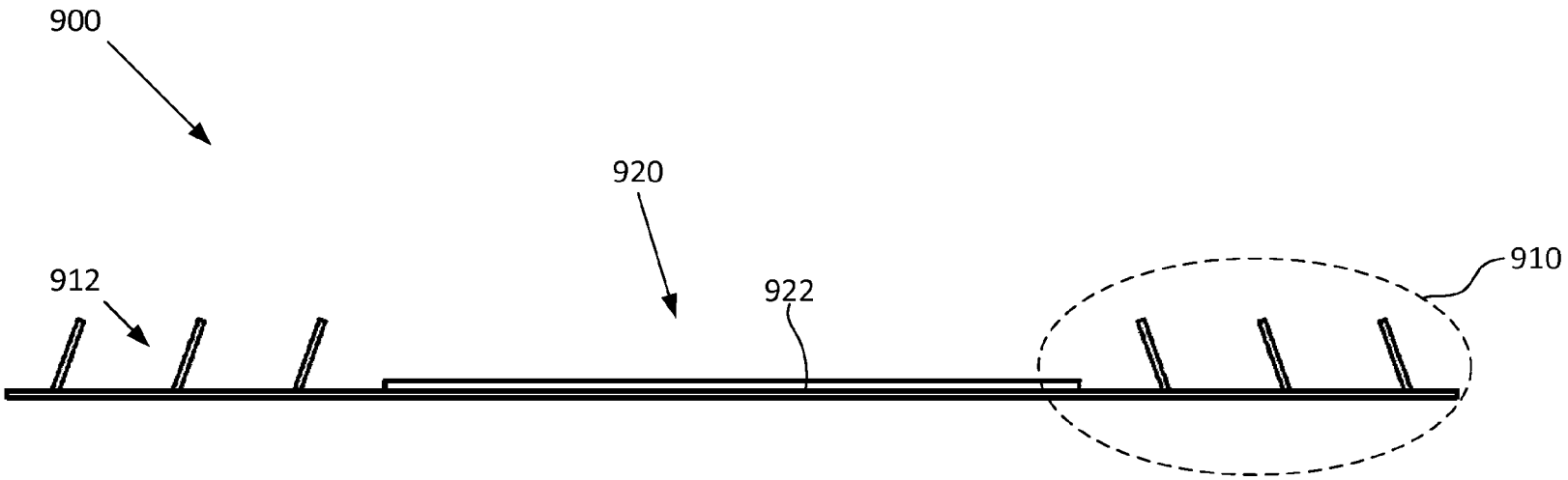
FIG. 9*a* is a cross-sectional view of an embodiment of a seaming apparatus of the present invention.

With reference now to FIG. 9*a*, a lateral view of the seaming apparatus 900 according to the present invention is provided. The seaming apparatus 900 is divided into edge zones 910 and 912 and central adhesive zone 920. In a preferred embodiment, the apparatus is 0.35 mm thick in the edge zones 910 and 912 and 0.50 mm thick in the central zone 920 with the adhesive strip 922 applied. Situated on the upper planar surface of the central zone 920 is an adhesive strip 922. The adhesive strip may be either a pressure sensitive fiber tape or pressure sensitive rubber tape depending on the desired application of the seaming apparatus 900. The adhesive strip 922 must be applied exactly in the center of the central zone 920 so as not to slip under one row of the projections in the edge zones 910 and 912 and be off center. On the bottom or reverse side of the seaming apparatus 900 a thin layer of pressure sensitive fiber tape may be applied. In a preferred embodiment, the seaming apparatus 900 is used in a "complete glue down" carpet installation application. In this type of application, power stretching and heated glue are not used on the carpet because the entire carpet is glued down. The pressure sensitive fiber tape is protected by a releasable, peelable silicone backing paper. This configuration allows an installer to glue down all portions of the carpet except for the carpet seams. The seaming apparatus 900 is then applied in the seam and the seaming is completed. Use of the seaming apparatus 900 in this manner does not require the use of power stretching or hot melt tape and thus reduces the time and effort needed to install the carpeting. The edge zone 910 can be seen in greater detail in FIG. 9*b*.

Figure 9B:
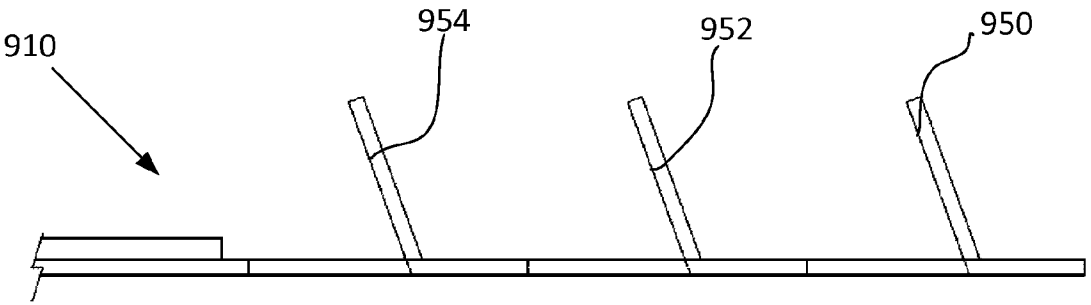
FIG. 9*b* is a detailed view of a cross-section of the upstanding projections of an embodiment of a seaming apparatus of the present invention.

With reference now to FIG. 9*b*, a detailed lateral view of edge zone 910 is provided. Three upstanding projections 950, 952, and 954 are provided. The projections 950 and 954 would be arranged in the same row, while projection 952 would be in a separate row. Each projection 950, 952, and 954 would be in separate columns in the edge zone 910. In a preferred embodiment, the length of each projection from the attached proximal end to the protruding distal end is 4 mm. Each projection protrudes at an angle of 70 degrees from the upper planar surface of the edge zone 910. The distance from the surface of the edge zone 910 to the distal end of the projection 950 would be 3.7 mm if the projection is protruding at an angle of 70 degrees. The particular angle, length, width, and arrangement of the projections in the edge zone is designed to optimally secure a commercial carpet seam.

Figures 10A, 10B, 11A, 11B:
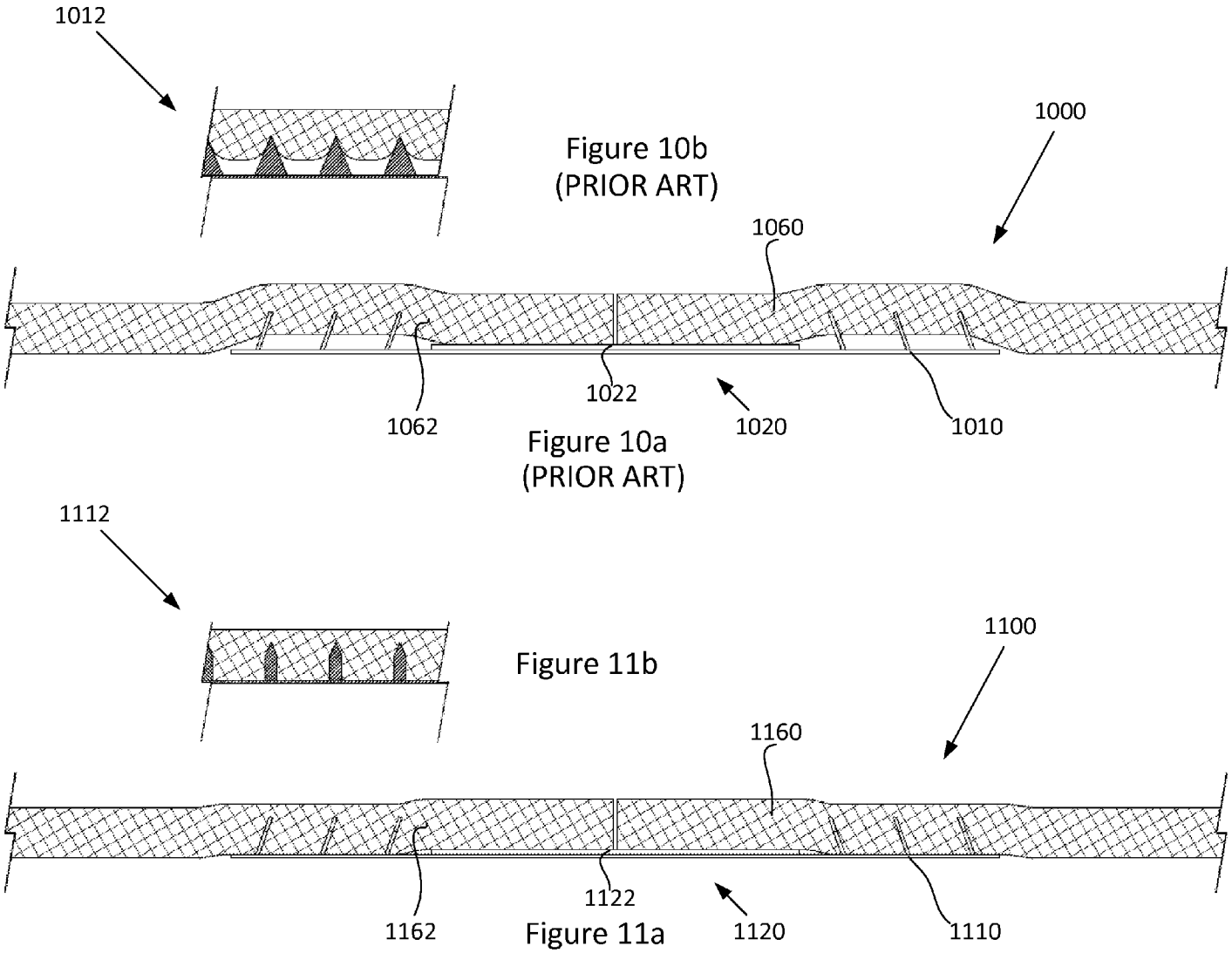
Figure 10b (PRIOR ART)
Figure 10a (PRIOR ART)
FIG. 10*a* is a cross sectional view of two carpet sections joined by a prior art carpet seaming apparatus.
FIG. 10*b* is a detailed view of prior art upstanding projections penetrating a carpet section.
FIG. 11*a* is a cross sectional view of an embodiment of a seaming apparatus of the present invention joining two carpet sections.
FIG. 11*b* is a detailed view of an embodiment of upstanding projections of the present invention penetrating a carpet section.

With reference now to FIGS. 10*a* and 10*b*, a detailed view of two sections of carpet 1060 and 1062 joined by a prior art carpet seaming apparatus 1000 is provided. The two carpet sections 1060 and 1062 are joined in the central adhesive zone 1020 by adhesive strip 2022. A plurality of upstanding projections in edge zone 1010 penetrate the bottom layer of the carpet section 1060 to further secure the section 1060 in place. However, the triangular shape of the projections 1012, as seen in FIG. 10*b*, prevent the projections 1012 from fully penetrating the backing or bottom of denser carpets. The lack of full penetration of the backing causes "profiling" of the carpet sections 1060 and 1062 in the area above the edge zones.

With reference now to FIGS. 11*a* and 11*b*, a detailed view of two sections of carpet 1160 and 1162 joined by a carpet seaming apparatus 1100 according to the present invention is provided. The seaming apparatus 1100 comprises two edge zones 1110 and a central adhesive zone 1120. A plurality of upstanding projections in the edge zone 1110 along with an adhesive strip 1122 in the central adhesive zone 1120 hold the two carpet sections 1160 and 1162 firmly in place. As can be seen in FIG. 11*b*, the narrow upstanding projections 1112 fully penetrate the backing of the carpet section. The nail like shape and elongated design of the narrow upstanding projections 1112 allow the projections to fully penetrate the backing, eliminating carpet "profiling" caused by the prior art apparatus 1000 of FIG. 10*a*.

Figure 12:
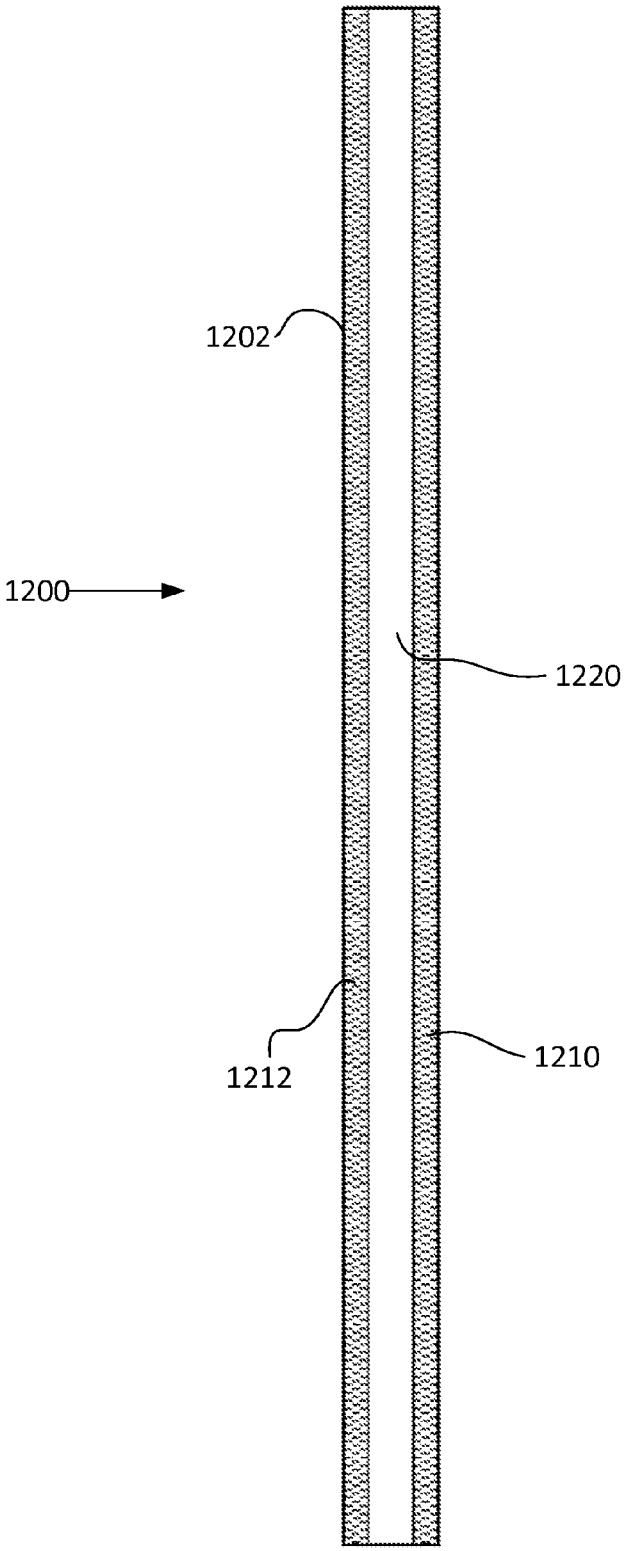
FIG. 12 is a plan view of another embodiment of a seaming apparatus of the present invention.

With reference now to FIG. 12, a plan view of the seaming apparatus 1200 of the present invention is provided. Seaming apparatus 1200 comprises an elongated plate 1202. The plate 1202 is preferably formed from metal so as to be inextendible in both longitudinal and transverse directions. In the preferred embodiment, the plate 1202 is formed from galvanized sheet metal and is 76.2 mm in width. It is to be understood that other inextendible materials, including a rigid plastic material, could be utilized to form plate 1202.

The upper surface of plate 1202 is divided into three zones. The adhesive zone 1220 and edge zones 1210 and 1212 generally define strips that run the full length of plate 602. In a preferred embodiment, the central adhesive zone 1220 is 36.5 mm in width, or 41.6% of the width, and both edge, or "tooth", zones 1210 and 1212 are 19.85 mm in width, or a total of 58.4% of the width.

Positioned on the upper surface of the plate 1202 and within the central adhesive zone 1220 is a strip of adhesive. In a preferred embodiment of the present invention, a pressure sensitive butyl rubber tape will be used. A peelable silicon protective cover may be placed on top of the strip of adhesive in the central adhesive zone 1220. Although preferred embodiments of the invention use a form of adhesive tape, it should be readily understood that other types of arrangements could be utilized to provide a layer of adhesive in the central adhesive zone 1220.

In each of the edge zones 1210 and 1212, a plurality of sharp upstanding projections arranged in rows and columns are provided throughout the surface of the edge zones 1210 and 1212. The specific arrangement of the plurality of upstanding projections is illustrated in greater detail in FIGS. 13 and 14.

Figure 13:
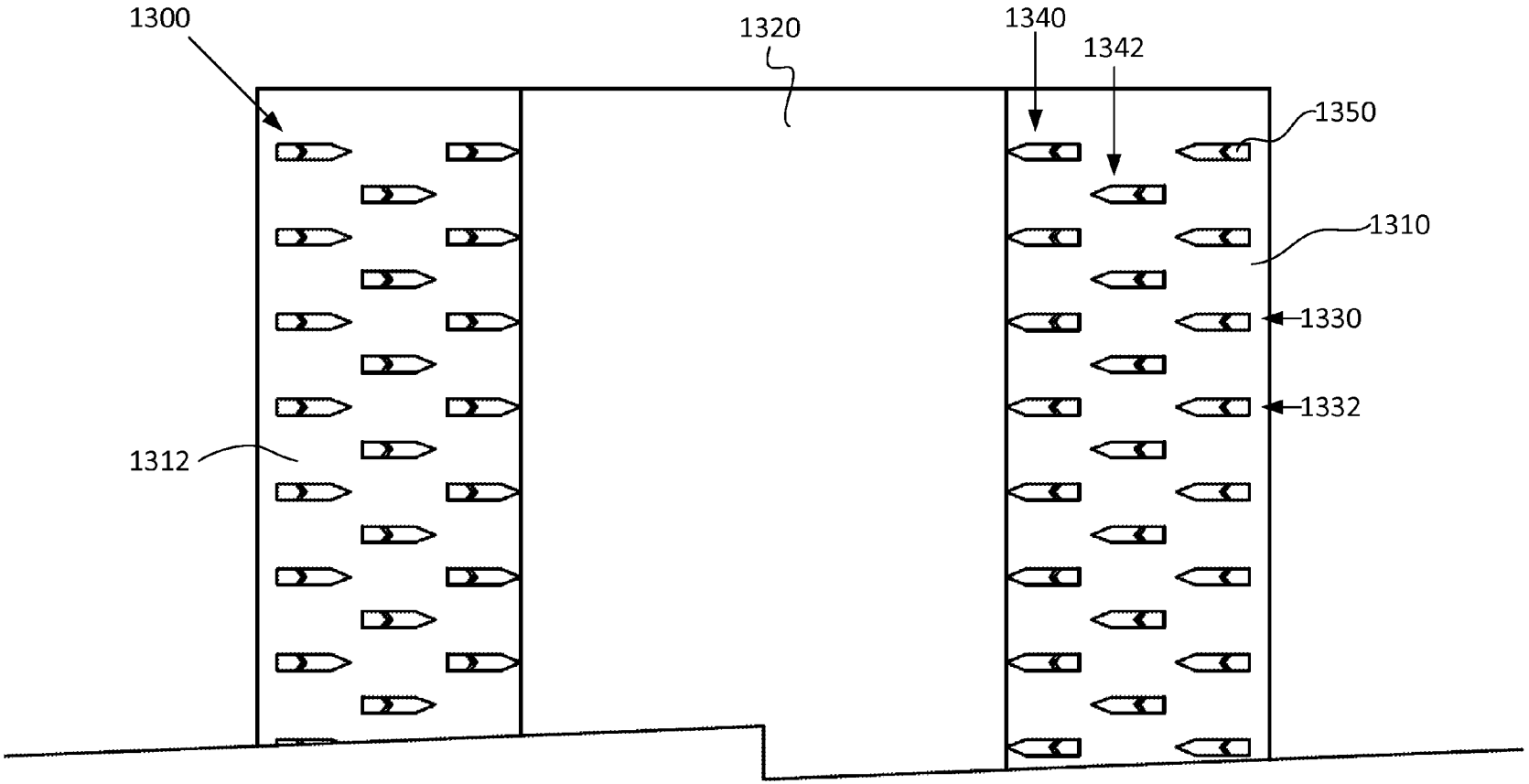
FIG. 13 is a plan view of the terminal end of an embodiment of a seaming apparatus of the present invention.

With reference now to FIG. 13, an end portion 1300 of a seaming apparatus according to the present invention is provided. The end portion 1300 primarily comprises a central adhesive portion 1320 and edge portions 1310 and 1312. The edge portion 1310 has a plurality of upstanding projections 1350 arranged in rows, such as rows 1330 and 1332, and columns, such as columns 1340 and 1342. The particular arrangement of the upstanding projections in this embodiment provide a substantial improvement over the prior art. Each upstanding projection, such as projection 1350, is "nail" shaped compared to the "triangular" shaped projections 110 seen in the prior art in FIG. 1. The length of each projection is 5.5 mm from the proximal to the distal end, and the width of each projection is 1.2 mm. The necessity of the longer, narrower projections is due to the thickness and density of the backings in commercial carpet applications. Commercial type carpeting backing has a much greater density, and in order to penetrate and secure the backing of the carpeting, each projection 1350 must be longer and narrower than those provided in the prior art. The distance between the rows, such as rows 1330 and 1332 and columns 1340 and 1342 has also changed relative to that of the prior art to increase effectiveness when used to secure commercial carpeting. Furthermore, the narrower projections "seat" properly in denser carpets compared to the prior art. The prior art projections may create "humps" or profiles in the carpet seams because they do not seat properly in denser carpeting. The projections of the present invention minimize profiling and may be used with denser or "woven" carpeting as is normally used in commercial carpeting applications. The projections can be seen in greater detail in FIG. 14.

Figure 14:
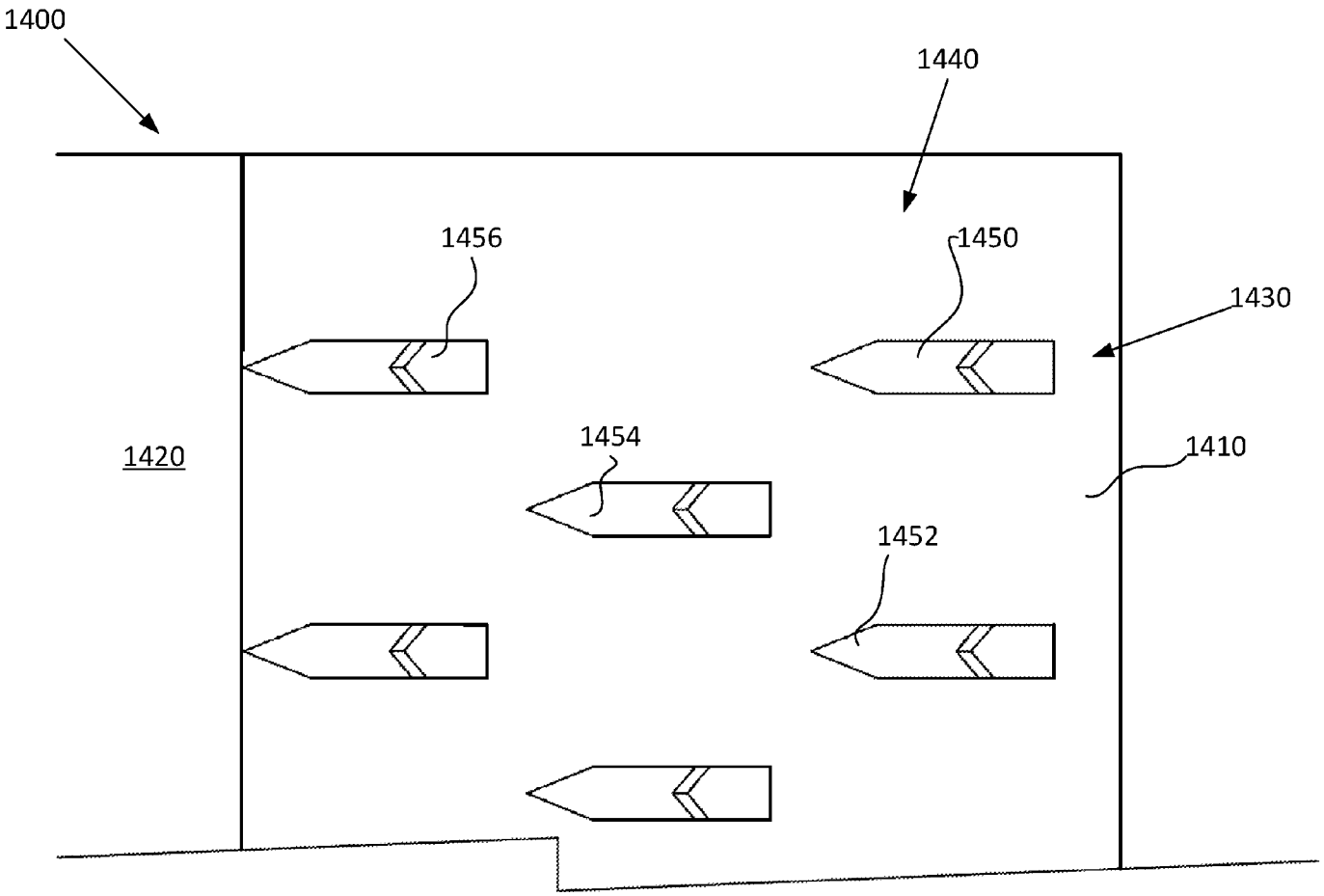
FIG. 14 is a plan view of upstanding projections in an embodiment of a seaming apparatus of the present invention.

With reference now to FIG. 14, a detailed view of the corner 1400 of the seaming apparatus is provided. The edge zone 1410 and central adhesive zone 1420 are shown. The edge zone 1410 is provided throughout its length with upstanding projections, such as projections 1450, 1452, 1454, and 1456, arranged in rows, such as row 1430, and columns, such as columns 1440. The projections in the edge zone 1410 are arranged in three columns covering the entire length of the edge zone 1410. In a preferred embodiment, each projection, such as projection 1450, is 5.5 mm in length from the attached proximal end to the protruding distal end. The width of projection 1450 is 1.2 mm. The distance between each projection, such as projections 1450 and 1452 in column 1440 is 5.2 mm. The distance between the distal end of projection 1450 and the proximal end of projection 1454 is 0.9 mm. The distance between the distal end of the projection 1450 and the proximal end of projection 1456 in row 1430 is 7.3 mm. The projections, arranged in rows and columns, are equally spaced throughout the edge zone 1410.

Figure 15A:
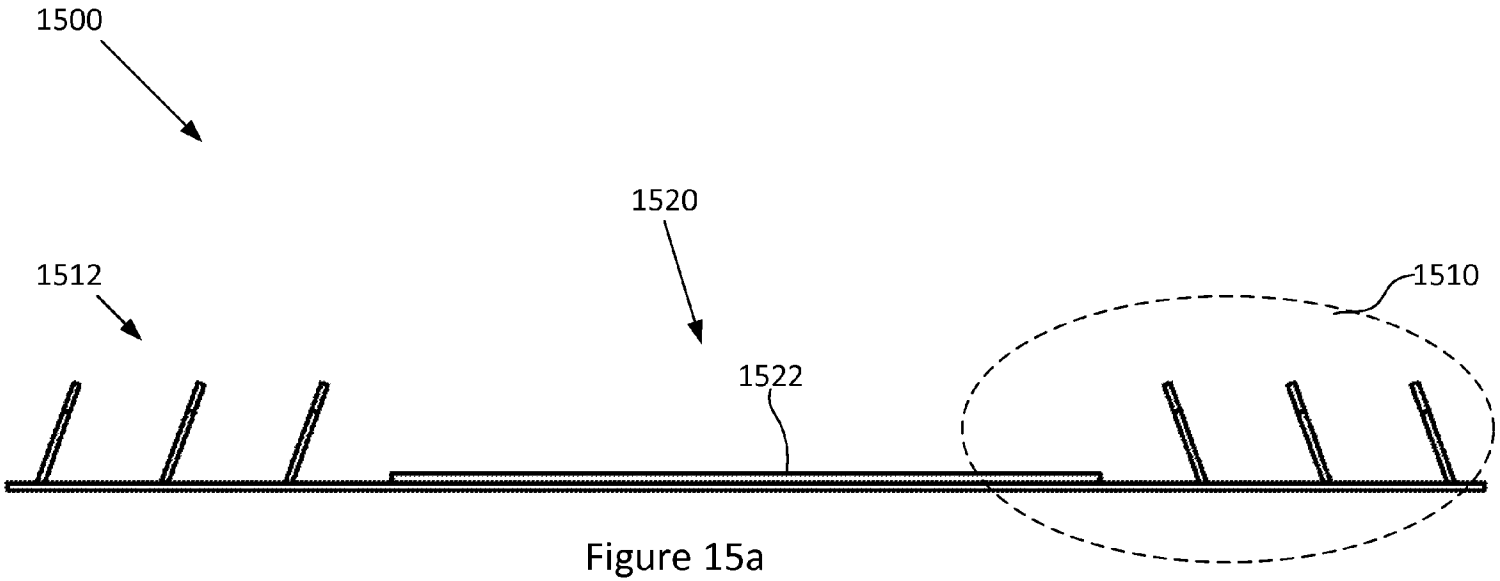
FIG. 15*a* is a cross-sectional view of an embodiment of a seaming apparatus of the present invention.

With reference now to FIG. 15*a*, a lateral view of the seaming apparatus 1500 according to the present invention is provided. The seaming apparatus 1500 is divided into edge zones 1510 and 1512 and central adhesive zone 1520. In a preferred embodiment, the apparatus is 0.35 mm thick in the edge zones 1510 and 1512 and 0.50 mm thick in the central zone 1520 with the adhesive strip 1522 applied. Situated on the upper planar surface of the central zone 1520 is an adhesive strip 1522. The adhesive strip may be either a pressure sensitive fiber tape or pressure sensitive rubber tape depending on the desired application of the seaming apparatus 1500. The adhesive strip 1522 must be applied exactly in the center of the central zone 1520 so as not to slip under one row of the projections in the edge zones 1510 and 1512 and be off center. On the bottom or reverse side of the seaming apparatus 1500 a thin layer of pressure sensitive fiber tape may be applied. In a preferred embodiment, the seaming apparatus 1500 is used in a "complete glue down" carpet installation application. In this type of application, power stretching and heated glue are not used on the carpet because the entire carpet is glued down. The pressure sensitive fiber tape is protected by a releasable, peelable silicone backing paper. This configuration allows an installer to glue down all portions of the carpet except for the carpet seams. The seaming apparatus 1500 is then applied in the seam and the seaming is completed. Use of the seaming apparatus 1500 in this manner does not require the use of power stretching or hot melt tape and thus reduces the time and effort needed to install the carpeting. The edge zone 1510 can be seen in greater detail in FIG. 15*b*.

Figure 15B:
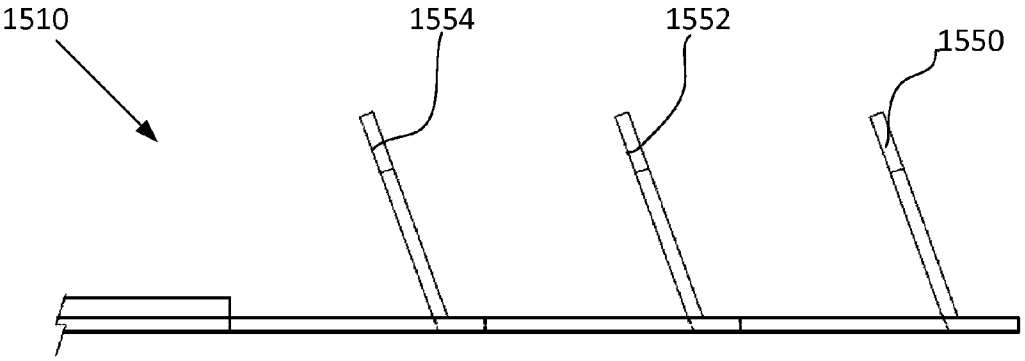
FIG. 15*b* is a detailed view of a cross-section of the upstanding projections of an embodiment of a seaming apparatus of the present invention.

With reference now to FIG. 15*b*, a detailed lateral view of edge zone 1510 is provided. Three upstanding projections 1550, 1552, and 1554 are provided. The projections 1550 and 1554 would be arranged in the same row, while projection 552 would be in a separate row. Each projection 1550, 1552, and 1554 would be in separate columns in the edge zone 1510. In a preferred embodiment, the length of each projection from the attached proximal end to the protruding distal end is 5.5 mm. Each projection protrudes at an angle of 70 degrees from the upper planar surface of the edge zone 1510. The distance from the surface of the edge zone 1510 to the distal end of the projection 1550 would be 5.1 mm if the projection is protruding at an angle of 70 degrees. The particular angle, length, width, and arrangement of the projections in the edge zone is designed to optimally secure a commercial carpet seam.

Figures 16A, 16B:
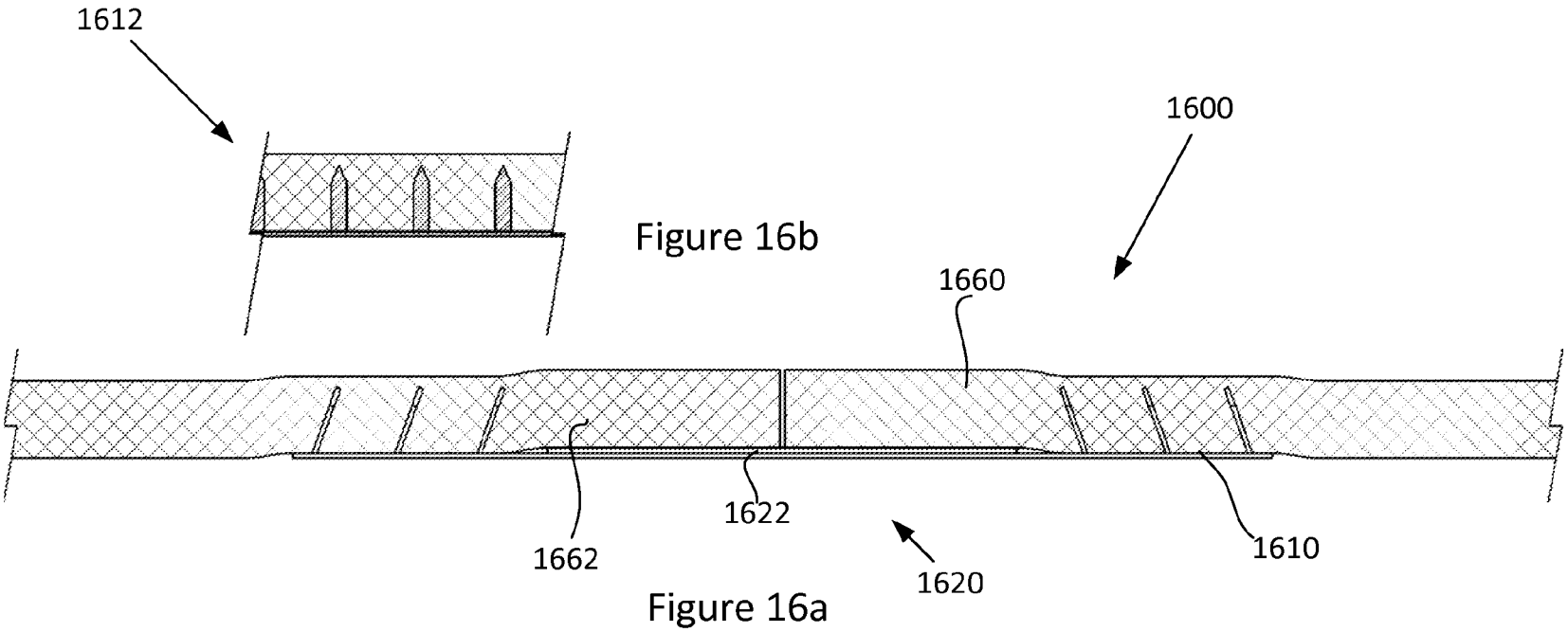
FIG. 16*a* is a cross sectional view of an embodiment of a seaming apparatus of the present invention joining two carpet sections.
FIG. 16*b* is a detailed view of an embodiment of upstanding projections of the present invention penetrating a carpet section.

With reference now to FIGS. 16*a* and 16*b*, a detailed view of two sections of carpet 1660 and 1662 joined by a carpet seaming apparatus 1600 according to the present invention is provided. The seaming apparatus 1600 comprises two edge zones 1610 and a central adhesive zone 1620. A plurality of upstanding projections in the edge zone 1610 along with an adhesive strip 1622 in the central adhesive zone 1620 hold the two carpet sections 1660 and 1662 firmly in place. As can be seen in FIG. 16*b*, the narrow upstanding projections 1612 fully penetrate the backing of the carpet section. The nail like shape and elongated design of the narrow upstanding projections 1612 allow the projections to fully penetrate the backing, eliminating carpet "profiling" caused by the prior art apparatus 1000 of FIG. 10*a*.

Furthermore, with respect to the carpet seaming apparatus provided in FIGS. 12, 13, 14, 15*a*, 15*b*, 16*a*, and 16*b*, the increased length of the upstanding projections from 4.0 mm (as shown in FIGS. 6, 7, 8, 9*a*, 9*b*, 11*a*, and 11*b*) to 5.5 mm provides for increased benefits in residential and some commercial carpeting applications. The increased length of the upstanding projections in these embodiments increases penetration of the carpet backing and firmly secures the carpet in place in applications where the carpet backing is particularly thick or dense. The increased length of the upstanding projections also further reduces the problem of carpet profiling in these applications.

From the above description, it should be readily apparent that an efficient and effective seaming arrangement is provided by the present invention which will eliminate seam failure problems in both artificial turf and commercial carpet applications.

While the invention has been described by reference to certain preferred embodiments, it should be understood that numerous changes could be made within the spirit and scope of the inventive concept described. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

We claim:

1. A weather and wear resistant seaming apparatus for seaming floor covering sections having dense or thick backing layers comprising:

an elongated plate having an upper surface and a lower surface, said lower surface being substantially smooth and said upper surface being divided into multiple transversely spaced and longitudinally extending zones including first and second edge zones which are laterally spaced by a central zone, said plate being inextendible in both longitudinal and lateral directions;

a plurality of sharp, elongated projections extending upwardly at spaced locations from said first and second edge zones, said projections having a top and an elongated body portion, the elongated body portion being essentially non-tapered, the top being sharply tapered to promote piercing engagement with a dense or thick floor covering backing and the elongated body extending upwards from the upper surface at an angle of less than 90 degrees; and a pressure sensitive adhesive layer positioned within said central zone and extending substantially entirely the length of said elongated plate, said plate being adapted to be positioned upon a supporting surface and interconnected to said floor covering sections to be seamed by positioning said plate below said floor covering sections with terminal edge portions of said floor covering sections being fixably engaged with said adhesive layer and with a respective set of said projections and abutting in said central zone.

2. The seaming apparatus of claim 1, wherein the apparatus is further adapted to join said floor covering sections whereby said floor covering sections can be simultaneously stretched with said plate sliding relative to the supporting surface.

3. The seaming apparatus of claim 1, wherein said projections are located solely in said first and second edge zones.

4. The seaming apparatus of claim 1, wherein said adhesive layer is located solely in said central zone.

5. The seaming apparatus of claim 1, wherein said lower surface further comprises a thin adhesive layer.

6. The seaming apparatus of claim 1, wherein said plate is formed of metal and said projections are constituted by cut portions of said plate which are bent upwardly above said upper surface.

7. The seaming apparatus of claim 1, wherein said projections are angled toward said central zone.

8. The seaming apparatus of claim 1 wherein said projections are angled toward said central zone at an angle of 70 degrees from said upper surface.

9. The seaming apparatus of claim 1 wherein said projections are 8 mm in length from an attached proximal end to a projecting distal end.

10. The seaming apparatus of claim 1 wherein said projections are 5.5 mm in length from an attached proximal end to a projecting distal end.

11. The seaming apparatus of claim 1 wherein said projections are arranged in three columns in each of said edge zones.

12. The seaming apparatus of claim 1 wherein said projections are arranged in four columns in each of said edge zones.

13. The seaming apparatus of claim 1, wherein said adhesive layer comprises a double-sided pressure sensitive adhesive tape having a lower side adhered to said central zone and an upper side adapted to be adhesively secured to the floor covering.

14. The seaming apparatus of claim 13, further comprising a protective, peelable cover positioned atop said adhesive tape.

15. The seaming apparatus of claim 13 wherein said adhesive layer comprises pressure sensitive butyl rubber tape.

16. The seaming apparatus of claim 13 wherein said adhesive layer comprises pressure sensitive fiber tape.

17. The carpet seaming apparatus according to claim 1, wherein said plate is formed of galvanized sheet metal of a gauge between 26 gauge and 32 gauge.

* * * * *